US005831581A

United States Patent [19]

Keough

[11] Patent Number: 5,831,581

[45] Date of Patent: Nov. 3, 1998

[54] DUAL FREQUENCY BAND PLANAR ARRAY ANTENNA

[75] Inventor: Shaun M. Keough, Bedford, Tex.

[73] Assignee: Lockheed Martin Vought Systems Corporation, Grand Prairie, Tex.

[21] Appl. No.: 702,281

[22] Filed: Aug. 23, 1996

[51] Int. Cl.[6] ..... H01Q 21/00; H01Q 1/00

[52] U.S. Cl. ..... 343/725; 343/729; 343/700 MS; 343/771

[58] Field of Search ..... 343/725, 729, 343/700 MS, 767, 768, 770, 771; H01Q 1/38, 21/00, 1/00, 13/10

[56] References Cited

U.S. PATENT DOCUMENTS

| | | | |
|---|---|---|---|
| 3,771,158 | 11/1973 | Hatcher | 343/728 |
| 4,698,638 | 10/1987 | Branigan et al. | 343/725 |
| 4,864,314 | 9/1989 | Bond | 343/700 MS |
| 5,394,163 | 2/1995 | Bullen et al. | 343/771 |
| 5,400,042 | 3/1995 | Tulintseff | 343/727 |
| 5,451,969 | 9/1995 | Toth et al. | 343/725 |

FOREIGN PATENT DOCUMENTS 0384777 8/1990 European Pat. Off. .

*Primary Examiner*—Hoanganh T. Le
*Attorney, Agent, or Firm*—Sidley & Austin

[57] ABSTRACT

A dual band monopulse radar antenna has a planar configuration and is divided into four quadrants. The antenna includes a circular plate with an array of slots formed in each quadrant. The slots are configured for operation at a first frequency, such as X-band. Four respective slot waveguide feeds are provided, one for each array of slots in each quadrant. A dielectric layer, such as Teflon, is mounted on the surface of the plate. Each quadrant of the antenna is provided with an array of microwave patch elements comprising a plurality of rows of patch elements fed by a microstrip line. Each array of microwave patch elements is fed by a waveguide. The antenna has eight waveguide couplers, two for each quadrant of the antenna with one waveguide feed in each quadrant for the slot array and one waveguide coupler in each array for the microwave patch element array.

11 Claims, 5 Drawing Sheets

FIG. 1
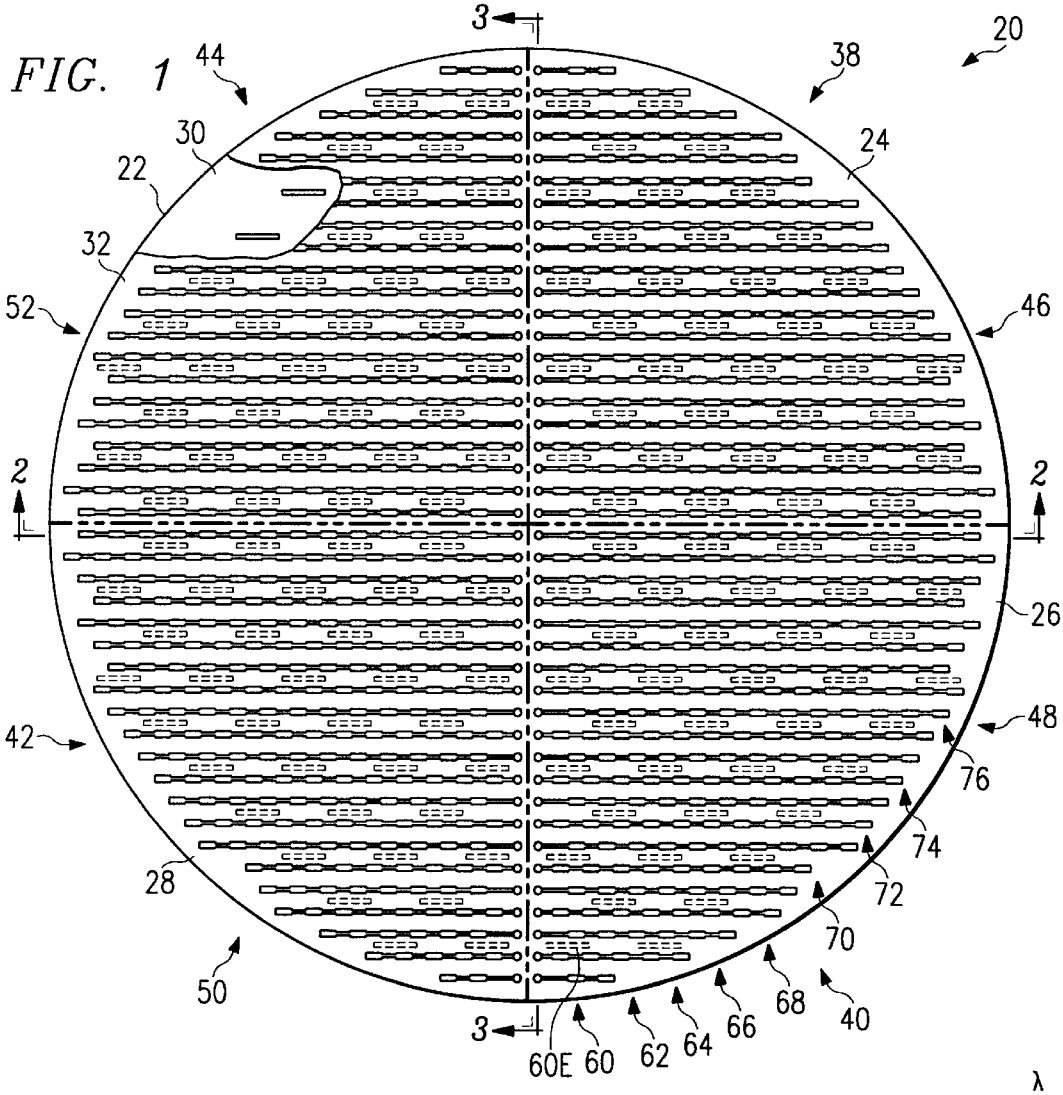
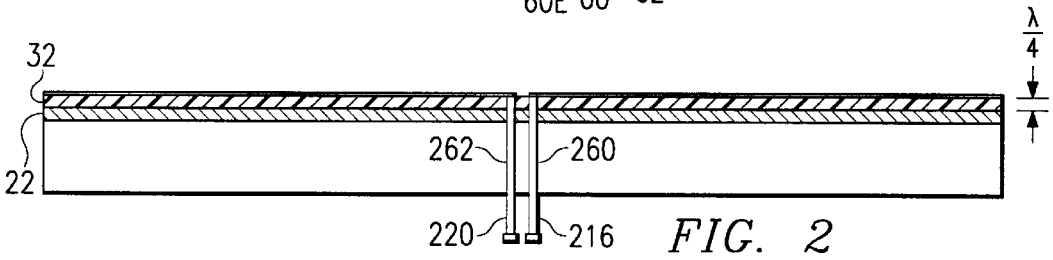
FIG. 2
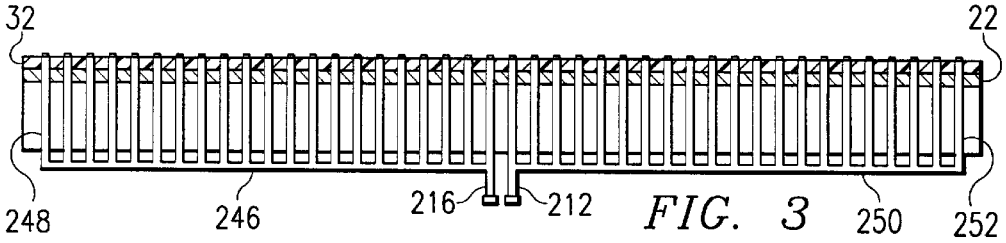
FIG. 3

DUAL FREQUENCY BAND PLANAR ARRAY ANTENNA

TECHNICAL FIELD OF THE INVENTION

The present invention pertains in general to microwave frequency antennas and in particular to such antennas having both patch and slot elements.

BACKGROUND OF THE INVENTION

A dual frequency, planar, microwave antenna has numerous advantageous features over parabolic or other non-planar multi-frequency antennas. Examples of antennas of this general type are shown in U.S. Pat. No. 5,400,042 entitled "Dual Frequency, Dual Polarized, Multi-Layered Microstrip Slot and Dipole Array Antenna", U.S. Pat. No. 3,771,158 entitled "Compact Multi Frequency Band Antenna Structure", and U.S. Pat. No. 4,864,314 entitled "Dual Band Antennas with Microstrip Array Mounted Atop a Slot Array".

The present invention is directed to a new configuration for a planar, dual band antenna having both slots and microwave patch elements. The present invention provides enhanced operation for a monopulse antenna operating at multiple frequencies. Monopulse antennas are particularly applicable in aerospace applications such as missile tracking where size, strength, accuracy, power and frequency diversity are important. The novel antenna configuration set forth herein provides improvements for many of these operational characteristics.

SUMMARY OF THE INVENTION

A selected embodiment of the present invention is a dual band planar array antenna which includes a planar surface having four quadrants. An array of slots is formed in each of the quadrants of the planar surface. The slots are configured for operation at the first frequency band. A respective waveguide feed is provided for each array of slots in each of the antenna quadrants. A dielectric layer is mounted to the planar surface. An array of microwave antenna patch elements are mounted on a surface of the dielectric layer opposite the planar surface in each of the quadrants. The planar surface serves as a ground plane for the arrays of patch elements. The patch elements are configured for operation at a second frequency band. A respective waveguide feed is provided for each array of the patch elements with each array being located in a quadrant of the antenna.

BRIEF DESCRIPTION OF THE DRAWINGS

For a more complete understanding of the present invention and the advantage thereof, reference is now made to the following description taken in conjunction with the accompanying drawings in which:

FIG. 1 is a front, planar view of a dual frequency antenna in accordance with the present invention wherein a front dielectric covering and support has been partially removed to show the patch and slot antenna elements, FIG. 2 is a section view taken along lines 2—2 in FIG. 1 illustrating a portion of the waveguide to patch element feed for two quadrants of the antenna 20 shown in FIG. 1, FIG. 3 is an illustration taken along lines 3—3 of FIG. 1 showing further aspects of the waveguide to patch feed for the antenna 20 in FIG. 1.

DETAILED DESCRIPTION

A dual band monopulse radar antenna 20 in accordance with the present invention is illustrated in FIG. 1. Antenna 20 includes a circular, planar plate 22 which is preferably made of beryllium, has a thickness of approximately 50 mils and a diameter of approximately 15 inches for the illustrated embodiment. The antenna 20, as shown in the illustrated embodiment, is designed for concurrent operation at X-band and Ka-band.

Figure 4:
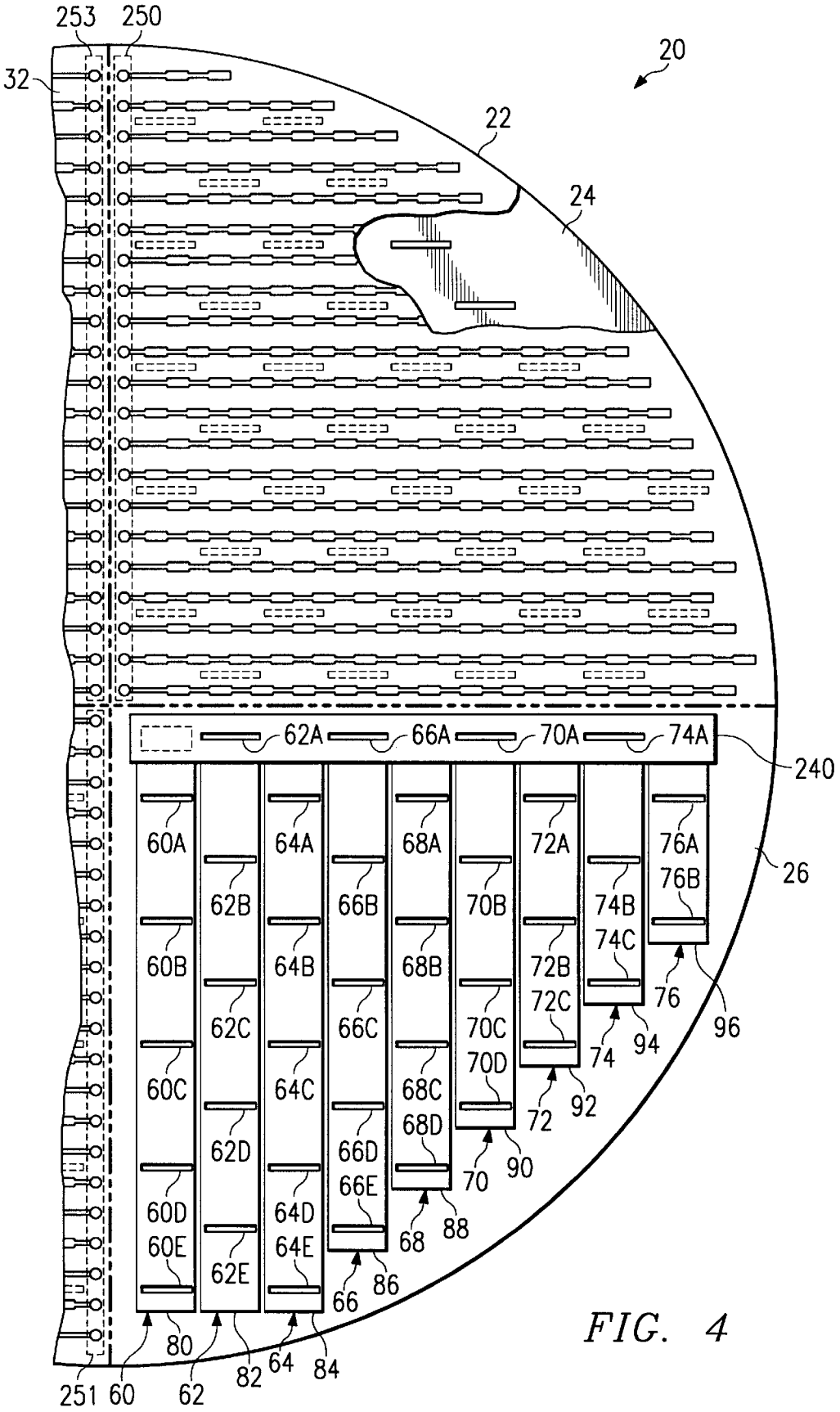
FIG. 4 is a partially cut away view of the antenna 20 shown in FIG. 1 with the frontal covering in place for the two antenna quadrants on the left-hand side, the front dielectric covering removed for the upper right-hand quadrant and a further cut away portion in the lower right-hand quadrant for showing the waveguide feed for the slot elements.

The antenna 20 is divided into quadrants 24, 26, 28 and 30, each comprising a 90° segment of the plate 22. The plate 22 has a planar surface. Section views of the antenna 20 are illustrated in FIGS. 2 and 3 for the section lines 2—2 and 3—3. The antenna 20 includes a dielectric layer 32 which is cut away in FIG. 1, but illustrated in the section views in FIGS. 2 and 3. The dielectric layer 32 covers the surface of the plate 22. The layer 32 is shown in FIGS. 2, 3 and 4.

Each of the quadrants 24–30 of the plate 22 has formed therein an array of slots. Quadrant 24 has a slot array 38. Quadrant 26 has a slot array 40. Quadrant 28 has a slot array 42 and quadrant 30 has a slot array 44. Each slot array is a group of rows of slots as further described below.

Each of the quadrants of the antenna 20 is further provided with an array of microwave patch elements. Quadrant 22 has a patch element array 46, quadrant 26 has a patch element array 48, quadrant 28 has a patch element array 50 and quadrant 30 has a patch element array 52.

The dielectric layer 32 is preferably made of Teflon®, and in particular a form of Teflon identified as Duroid®. As shown in FIG. 2, the dielectric layer 32 preferably has a thickness that is one-quarter of the wavelength for the frequency band of operation for the microwave patch element arrays. In the preferred embodiment, the microstrip patch element arrays are designed to operate at Ka-band. The patch elements are fabricated on the surface of the layer 32.

The antenna 20 consists of four substantially identical quadrants. The quadrant 26 is described in detail and is representative of all of the quadrants. Referring to FIGS. 1 and 4, the slot array 40 consists of nine vertical slot rows 60, 62, 64, 66, 68, 70, 72, 74 and 76. Row 60 has five slots, 60A, 60B, 60C, 60D and 60E. These slots extend through the plate 22 to a slot feed waveguide 80. Slot row 62 has slots 62A, 62B, 62C, 62D and 62E. These slots are connected to a slot feed waveguide 82. Slot row 64 is provided with slots 64A, 64B, 64C and 64D which are coupled to a slot feed waveguide 86. Slot row 66 has slots 66A, 66B, 66C, 66D and 66E.

Slot row 68 is provided with slots 68A, 68B, 68C and 68D which are connected to a slot feed waveguide 88. Slot row 70 is provided with slots 70A, 70B, 70C and 70D which are connected to a slot feed waveguide 90. The slot row 72 is provided with slots 72A, 72B and 72C which are connected to a slot feed waveguide 92. Slot row 74 is provided with slots 74A and 74B which are connected to slot feed waveguide 94. Finally, slot row 76 is provided with slots 76A and 76B which are connected to slot feed waveguide 96.

Figure 5:
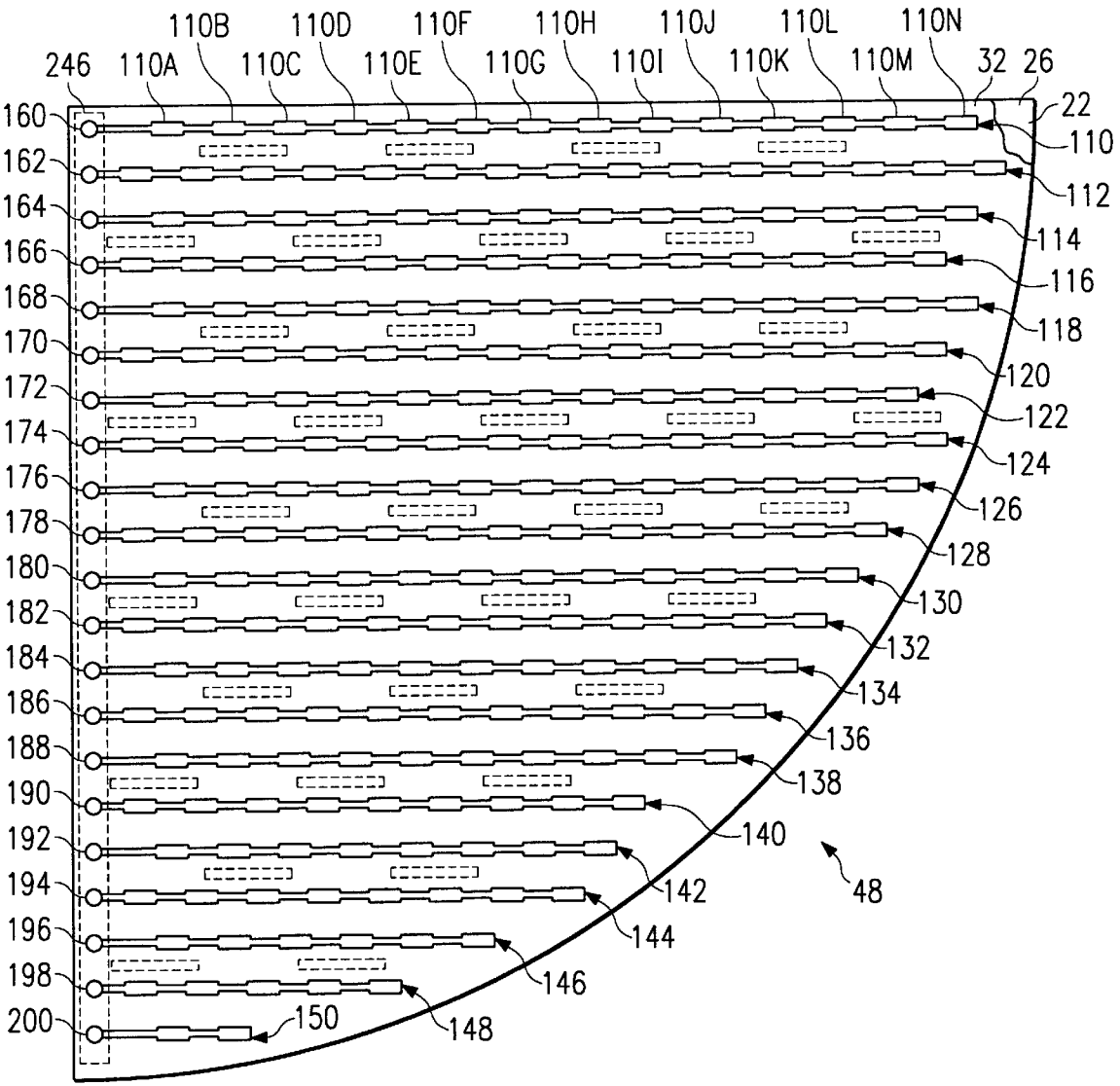
FIG. 5 is a planar, detailed view of one quadrant of the antenna 20 shown in FIG. 1.

The patch element array 48 in quadrant 26 is shown in additional detail in reference to FIG. 5. The array 48 consists of 21 rows of microwave patch elements that are interconnected by microstrip lines. The array 48 consists of patch element rows 110–150. Patch element row 110 has, for example, patch elements 110A–110N. Each of the patch elements is interconnected by a microstrip line which terminates at a microwave to microstrip adapter 160. For each of the patch element rows 112–150 there is a corresponding waveguide to microstrip adapter 162–200.

Figure 6:
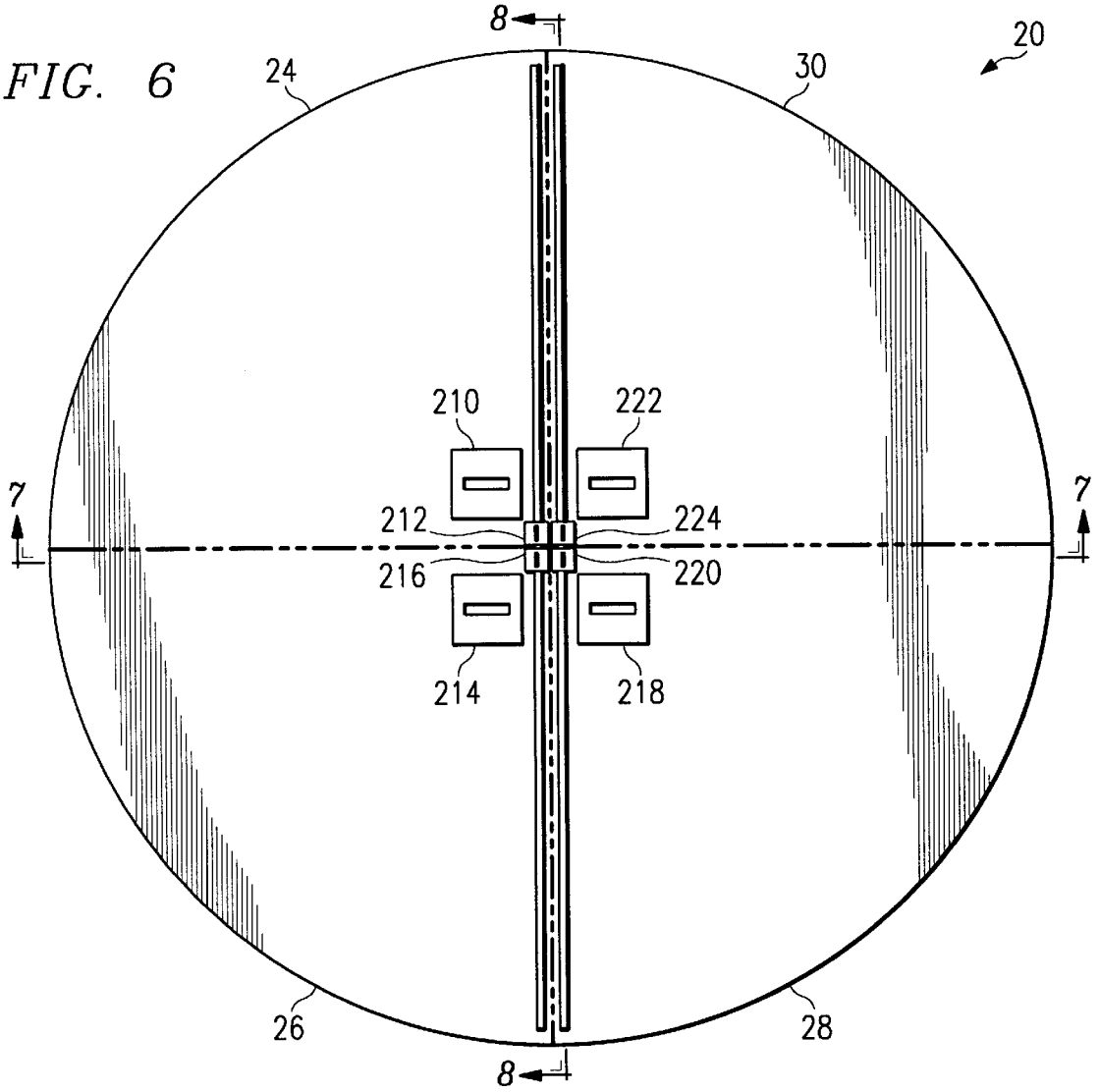
FIG. 6 is a rear, planar view of the antenna 20 shown in FIG. 1 particularly illustrating the waveguide coupler feeds for both the patch and slot elements for each of the four quadrants of the antenna.

Referring to FIG. 6, the quadrant 24 is provided with a slot coupler waveguide 210 and a patch coupler waveguide 212. Quadrant 26 is provided with a slot coupler waveguide 214 and a patch coupler waveguide 216. Quadrant 28 is provided with a slot coupler waveguide 218 and a patch coupler waveguide 220. Quadrant 30 is provided with a slot coupler waveguide 222 and a patch coupler waveguide 224. The coupler waveguides 210–224 are located symmetrically about the axis of the antenna 20 and are proximate the axis of the antenna 20.

Each of the slot coupler waveguides 210, 214, 218 and 222 are connected to a corresponding slot primary waveguide, which is perpendicular thereto. For quadrant 26, the slot coupler waveguide 214 is coupled to a slot primary waveguide 240, as shown in FIG. 4. Each of the slot feed waveguides 80–96 are connected to a side of the slot primary waveguide 240, and as shown the feed waveguides 80–96 are perpendicular to the slot primary waveguide 240.

In each of the quadrants, a patch coupler waveguide is coupled to a perpendicularly positioned patch primary waveguide which has a plurality of patch feed waveguides coupled in a perpendicular configuration thereto. For example, further referring to quadrant 26 in FIG. 6, patch coupler waveguide 216 is coupled to a patch primary waveguide 246 (FIG. 3). The waveguide 246 is coupled to a plurality of parallel patch feed waveguides, one of which is patch feed waveguide 248. The patch feed waveguide 248 is coupled to the waveguide to microstrip adapter 200 (FIG. 5) which is in turn coupled to the microstrip line for the patch element row 150. In a similar manner, there is a respective patch feed waveguide corresponding to waveguide 248 connected to the adapters 160–198.

Referring to FIG. 3, in a similar configuration for quadrant 22, the patch coupler waveguide 212 is connected to a patch primary waveguide 250 which is coupled to a plurality of parallel patch feed waveguides, one of which is feed waveguide 252. Waveguide 252 is perpendicular to the waveguide 250. The patch feed waveguide 252 is coupled to a waveguide to microstrip adapter for feeding the top patch element row in quadrant 22. (FIGS. 1 and 3)

Referring to FIG. 4, the patch feed waveguide 250 for quadrant 22 is shown in phantom lines. Corresponding patch feed waveguides 251 for quadrant 28 and 253 for quadrant 30 are also shown in phantom lines. Each of these patch feed waveguides is located immediately below the corresponding group of microstrip adaptors. The corresponding patch feed waveguide 246 is shown in phantom in FIG. 5 below adaptors 160–200.

Figure 7:
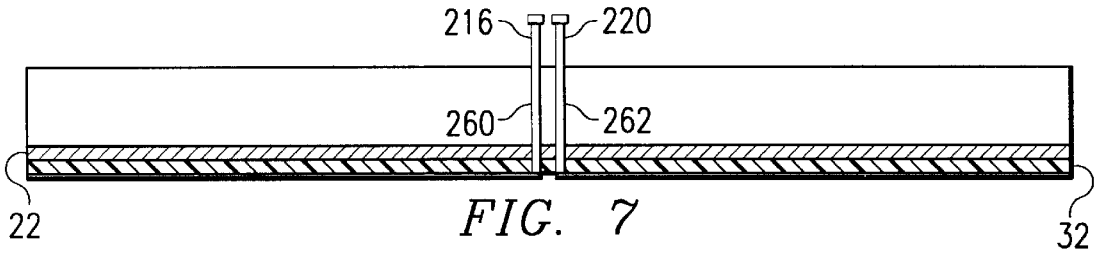
FIG. 7 is a section view taken along lines 7—7 of FIG. 6 illustrating a portion of the waveguide patch feed.

In FIG. 7, the patch coupler waveguide 216 for quadrant 26 is coupled directly to a parallel patch feed waveguide 260, which is in turn connected to the adapter 160 (FIG. 5). The patch coupler waveguide 220 is connected to a parallel positioned patch feed waveguide 262 for quadrant 28 and waveguide 262 is coupled to a corresponding adapter in quadrant 28.

Figure 8:
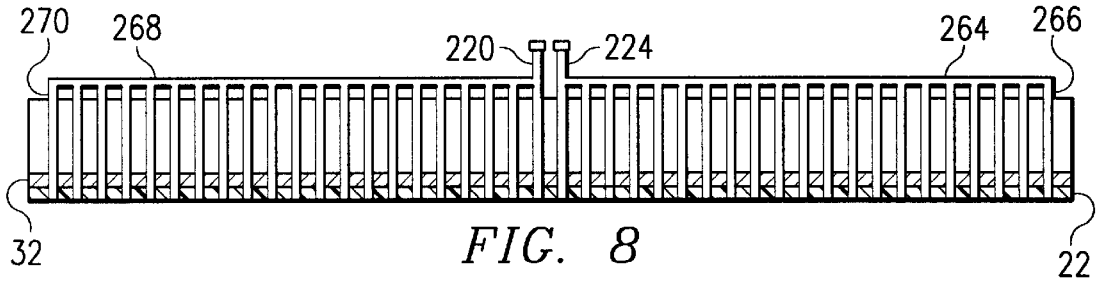
FIG. 8 is a section view taken along lines 8—8 of FIG. 6 further illustrating a portion of the waveguide patch feed for two quadrants of the antenna 20 shown in FIG. 6.

Referring to FIG. 8, the patch coupler waveguide 224 is coupled to a patch primary waveguide 264 which is in turn coupled to a plurality of perpendicular patch feed waveguides, including waveguide 266.

Further referring to FIG. 8, the patch coupler waveguide 220 is coupled to a patch primary waveguide 268 which is in turn coupled to a plurality of perpendicular patch feed waveguides, including waveguide 270.

Referring to FIGS. 1 and 6, the antenna 20 is preferably used for monopulse operation. The X-band and Ka-band antennas can be operated concurrently and independently. In a missile seeker antenna application, both antenna arrays can transmit substantial power to detect and track targets. The higher frequency (Ka-band) has reduced aimpoint errors and susceptibility to countermeasures. In typical operation, a pulse is transmitted through four of the microwave feeds for one band at one time. During the receive time period, the reflected radar signal is received independently by each of the four quadrants to provide four separate receive signals. These signals are phase compared to determine a pointing angle for locating a target in both azimuth and elevation with respect to the antenna 20.

The patch arrays with the serial patch elements are designed as shown in such a way that the low frequency signal (X-band) passes through the grid of the patch elements without significant loss or distortion. The grid of the patch elements provides cross polarization isolation for the slot array located below the patch element grid.

The configuration illustrated further provides amplitude taper wherein the greater amplitude is provided to the slots and patch elements closer to the center axis of the antenna. This produces an antenna pattern with minimized side lobes and with maximum peak lobe gain.

Figure 9:
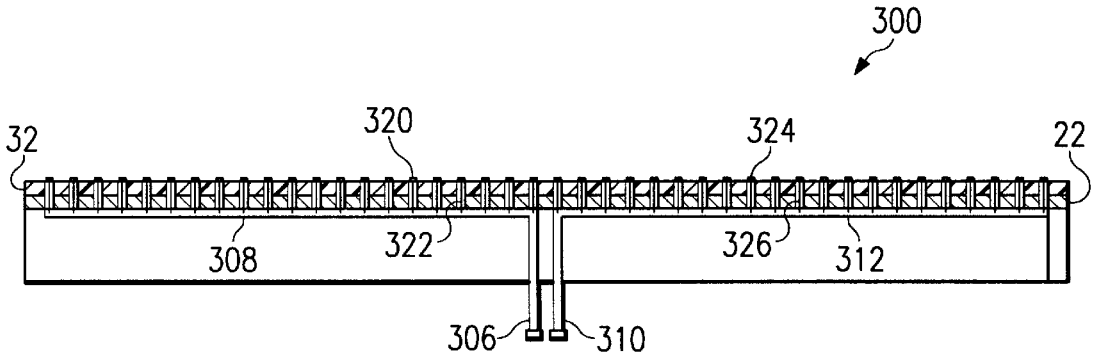
FIG. 9 is an alternative embodiment for the patch strip waveguide.

An alternative embodiment for the patch strip waveguide, such as shown in FIG. 9, is illustrated as assembly 300 (FIG. 9). A patch coupler waveguide 306 is connected to a perpendicularly oriented patch feed waveguide 308. In a similar fashion, a patch coupler waveguide 310 is connected to a feed waveguide 312. As with the previous configuration, there are a series group of waveguide to microstrip adaptors with representative adaptors being adaptor 320 and adaptor 324. Each of the adaptors is connected through a probe, such as probes 322 for adaptor 320 and probe 326 for adaptor 324. Each of the probes extends downward into the corresponding waveguide feed, such as probe 322 extending into feed waveguide 308 and probe 326 extending into feed waveguide 312. A similar configuration of waveguides are provided for the remaining two quadrants of an antenna to provide a full set of four quadrants of waveguide feeds for the microwave patches.

Although multiple embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

What I claim is:

1. A dual band planar array antenna, comprising:

a planar surface having four quadrants;

an array of slots formed in each of said quadrants of said planar surface, said slots configured for operation at a first frequency band, a respective waveguide feed for each said array of slots in each of said quadrants, a dielectric layer mounted to said planar surface, an array of patch elements mounted on a surface of said dielectric layer opposite said planar surface for each of said quadrants, wherein said planar surface is a ground plane for said patch elements, and said patch elements are configured for operation at a second frequency band, and a respective waveguide feed for each said array of patch elements in said quadrants.

2. A dual band planar array antenna as recited in claim 1 wherein said array of patch elements in each said quadrant comprises a plurality of parallel rows of patch elements with the patch elements in each row connected together with microstrip lines.

3. A dual band planar array antenna as recited in claim 1 wherein said array of slots in each quadrant comprises a plurality of parallel rows of slots with each slot opening into a waveguide feed.

4. A dual band planar array antenna as recited in claim 1 wherein said array of patch elements in each said quadrant comprises a plurality of parallel rows of patch elements with the patch elements in each row connected together with microstrip lines and wherein said array of slots in each quadrant comprises a plurality of parallel rows of slots with each slot opening into a waveguide feed, wherein said rows of patch elements are perpendicular to said rows of slots.

5. A dual band planar array antenna as recited in claim 1 wherein said planar surface is circular and each of said quadrants is a ninety degree segment of said circular planar surface.

6. A dual band planar array antenna as recited in claim 1 wherein said waveguide feed for each said array of slots includes a slot coupler waveguide which is perpendicular to said planar surface, a slot primary waveguide connected to said slot coupler waveguide and perpendicular thereto and a plurality of respective slot feed waveguides for a plurality of rows of said slots, wherein said slot feed waveguides are coupled to said slot primary waveguide and are perpendicular thereto.

7. A dual band planar array antenna as recited in claim 1 wherein said waveguide feed for each said array of patch elements comprises a patch coupler waveguide which is perpendicular to said planar surface, a patch primary waveguide connected to said patch coupler waveguide and perpendicular thereto, a plurality of respective patch feed waveguides for a plurality of rows of said patches, wherein said patch feed waveguides are coupled to said patch primary waveguide and are perpendicular thereto, a plurality of waveguide to strip line connectors connected respectively to said patch feed waveguides, and a plurality of microstrip lines connected respectively to said waveguide to strip line connectors and each microstrip line connected to feed a respective one of said rows of said patches.

8. A dual band planar array antenna as recited in claim 1 wherein said second frequency band is a higher frequency than said first frequency band.

9. A dual band planar array antenna as recited in claim 1 wherein said first frequency band is X-band and said second frequency band is Ka-band.

10. A dual band planar array antenna as recited in claim 1 wherein each of said waveguide feeds has a corresponding coupler waveguide positioned proximate the center axis of said planar surface and perpendicular to the plane of said planar surface.

11. A dual band planar array antenna as recited in claim 1 wherein said waveguide feed for each said array of patch elements comprises a patch coupler waveguide which is perpendicular to said planar surface, a patch feed waveguide connected to said patch coupler waveguide and perpendicular thereto, and a plurality of probe elements extending from said feed waveguide and respectively connected to a plurality of adaptors which are in turn connected to said patch elements.

* * * * *